US009869230B2

(12) United States Patent
Hornback

(10) Patent No.: US 9,869,230 B2
(45) Date of Patent: Jan. 16, 2018

(54) CAST MOUNTED SUB-STRUCTURE FOR END MODULE

(71) Applicant: FAURECIA EMISSIONS CONTROL TECHNOLOGIES, Columbus, IN (US)

(72) Inventor: Jerome Brian Hornback, Greenwood, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 125 days.

(21) Appl. No.: 14/784,383

(22) PCT Filed: Apr. 30, 2013

(86) PCT No.: PCT/US2013/038754

§ 371 (c)(1),
(2) Date: Oct. 14, 2015

(87) PCT Pub. No.: WO2014/178832

PCT Pub. Date: Nov. 6, 2014

(65) Prior Publication Data

US 2016/0076428 A1 Mar. 17, 2016

(51) Int. Cl.
*F01N 13/18* (2010.01)
*F01N 13/08* (2010.01)
(Continued)

(52) U.S. Cl.
CPC ..... *F01N 13/1838* (2013.01); *F01N 3/20* (2013.01); *F01N 13/009* (2014.06);
(Continued)

(58) Field of Classification Search
CPC ..... F01N 3/20; F01N 13/009; F01N 13/0097; F01N 13/08; F01N 13/14; F01N 13/1805;
(Continued)

(56) References Cited

U.S. PATENT DOCUMENTS 3,645,092 A 2/1972 Tatsutomi et al.
3,729,937 A 5/1973 Haddad
(Continued)

FOREIGN PATENT DOCUMENTS

EP 2287453 2/2011
JP 2010249074 11/2010
(Continued)

OTHER PUBLICATIONS

U.S. Appl. No. 12/049,441, filed May 17, 2008.
(Continued)

*Primary Examiner* — Audrey K Bradley
(74) *Attorney, Agent, or Firm* — Carlson, Gaskey & Olds, PC

(57) ABSTRACT

An end cap module for a vehicle exhaust system is comprised of an outer skin and inner skin that cooperate to define an internal cavity. The outer skin includes a mount interface configured for attachment to a vehicle structure. A cast internal sub-structure is mounted within the internal cavity. The inner skin positioned within the internal cavity such that the cast internal sub-structure is positioned between the inner skin and the outer skin.

30 Claims, 2 Drawing Sheets

(51) Int. Cl.
*F01N 13/14* (2010.01)
*F01N 3/20* (2006.01)
*F01N 13/00* (2010.01)

(52) U.S. Cl.
CPC ..... *F01N 13/0097* (2014.06); *F01N 13/08* (2013.01); *F01N 13/14* (2013.01); *F01N 13/1805* (2013.01); *F01N 13/1855* (2013.01); *F01N 13/1861* (2013.01); *F01N 13/1888* (2013.01)

(58) Field of Classification Search
CPC ..... F01N 13/1838; F01N 13/1855; F01N 13/1861; F01N 13/1888
See application file for complete search history.

(56) References Cited

U.S. PATENT DOCUMENTS

| | | | | |
|---|---|---|---|---|
| 3,819,208 | A | 6/1974 | Janle | |
| 4,167,207 | A | 9/1979 | Rao et al. | |
| 4,206,598 | A | 6/1980 | Rao et al. | |
| 5,018,661 | A | 5/1991 | Cyb | |
| 6,669,912 | B1 | 12/2003 | Udell | |
| 7,578,125 | B2 | 8/2009 | Hardesty et al. | |
| 8,250,859 | B2 | 8/2012 | Torisaka et al. | |
| 8,281,581 | B2 | 10/2012 | Oliver et al. | |
| 8,721,977 | B2 | 5/2014 | Wikaryasz et al. | |
| 2009/0232592 | A1 | 9/2009 | Gudorf et al. | |
| 2009/0260351 | A1 | 10/2009 | Cremeens et al. | |
| 2009/0272106 | A1* | 11/2009 | Werni | F01N 3/0335 60/297 |
| 2010/0095660 | A1 | 4/2010 | Oliver et al. | |
| 2012/0222767 | A1 | 9/2012 | Wikaryasz et al. | |
| 2013/0086894 | A1 | 4/2013 | Wikaryasz et al. | |

FOREIGN PATENT DOCUMENTS

| | | | | |
|---|---|---|---|---|
| JP | 2011047349 | | 3/2011 | |
| WO | 2013052224 | A1 | 4/2013 | |
| WO | WO 2013160655 | A1 * | 10/2013 | F01N 3/2892 |

OTHER PUBLICATIONS

T.Wrobel et al., "Examples of material solutions in bimetallic layering castings", Archives of Foundry Engineering, ISSN (1897-3310), vol. 11, Issue Mar. 2011, pp. 11-16.
M. Cholwea, et al., "Diffusion Pheonomena Between Alloy Steel and Gray Cast Iron in Layered Bimetalllic Casting", Archives of Metallurgy and Materials, vol. 55, Feb. 2010, Issue 3.
International Search Report from PCT/Us/2013/038754.
Supplementary European Search Report for European Application No. 13883488.2 dated Sep. 30, 2016.

* cited by examiner

CAST MOUNTED SUB-STRUCTURE FOR END MODULE

TECHNICAL FIELD

The subject invention relates to an end cap module that connects two exhaust components together, and which is rigidly attached to a vehicle structure.

BACKGROUND OF THE INVENTION

Exhaust systems are widely known and used with combustion engines. An exhaust system includes exhaust tubes that convey hot exhaust gases from the engine to other exhaust system components, such as catalytic converters, mufflers, resonators, etc. As known, the catalytic converter houses a catalyst through which the exhaust gas and excess air are passed so that carbon monoxide and hydrocarbon pollutants are oxidized to carbon dioxide and water.

An end cap mounting module connects the catalytic converter to an exhaust pipe. The end cap mounting module includes mounting structure such that the module can be mounted to a vehicle structure, such as a chassis for example.

In one known configuration, the end cap mounting module has been formed from a plurality of stamped metal sheet portions that are welded together. During operation, high load forces into the catalytic converter and end cap mounting module place significant stress levels on weld joint interfaces, especially those interfaces for the mounting structure. These stress levels can cause cracking at the weld joint interfaces, which adversely affects the durability of the part and can lead to premature failure.

In another known configuration, the end cap mounting module includes an end cap body that is cast as a single-piece component. The single-piece component includes a mount interface for connection to a catalytic converter and a mount interface for connection to a downstream exhaust pipe. This cast end cap mounting module overcomes disadvantages of the stamped end cap mounting module; however, at the expense of increasing the weight of the component. Further, having a cast structure requires the outer surface to be painted to avoid rusting, which further increases cost.

SUMMARY OF THE INVENTION

In one example embodiment, an end cap module for a vehicle exhaust system is comprised of an outer skin and inner skin that cooperate to define an internal cavity. The outer skin includes a mount interface configured for attachment to a vehicle structure. A cast internal sub-structure is mounted within the internal cavity such that the cast internal sub-structure is positioned between the inner skin and the outer skin.

In a further embodiment of the above, the outer skin is formed from unpainted sheet metal.

In a further embodiment of any of the above, the outer skin is comprised of at least a first portion and a second portion. The first portion includes a base surface that includes the mount interface, and the second portion includes a first connection interface for connection to a first exhaust component and a second connection interface for connection to a second exhaust component.

In a further embodiment of any of the above, the cast internal sub-structure rests on the base surface such that the first portion of the outer skin is sandwiched between the vehicle structure and the cast internal sub-structure In another exemplary embodiment, an end cap module for a vehicle exhaust system includes an outer skin including at least a first outer skin portion and a second outer skin portion. The first outer skin portion includes a mount interface configured for attachment to a vehicle structure. The second outer skin portion defines a first connection interface and a second connection interface. A cast internal sub-structure is mounted to the first outer skin portion. An inner skin is mounted between the first outer skin portion and the second outer skin portion to define an exhaust gas passageway that extends between the first and second connection interfaces. The cast internal sub-structure is positioned between the inner skin and first outer skin portion.

In a further embodiment of any of the above, the inner skin is comprised of at least a first inner skin portion and a second inner skin portion. The first inner skin portion includes a base surface that defines the exhaust gas passageway. The second inner skin portion includes a first opening aligned with the first connection interface and a second opening aligned with the second connection interface in the second outer skin portion.

In a further embodiment of any of the above, there is a first layer of insulation between the cast internal sub-structure and the first inner skin portion, and a second layer of insulation between the second outer skin portion and the second inner skin portion.

In another exemplary embodiment, a vehicle exhaust system includes a catalytic converter, an exhaust pipe, and an end cap module that connects the catalytic converter to the exhaust pipe. The end cap module is comprised of any of the variants described above.

DETAILED DESCRIPTION

Figure 1:
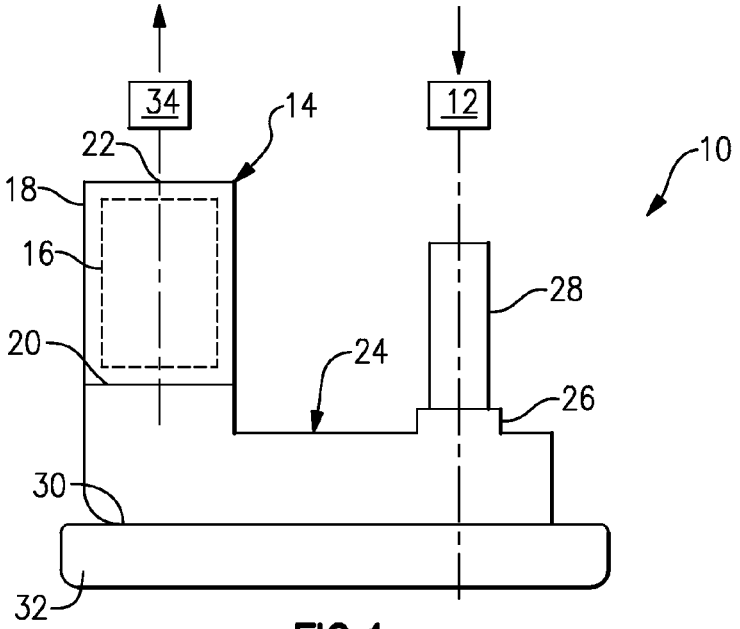
FIG. 1 is a schematic view of a vehicle exhaust system including an end cap module that is mounted to a vehicle structure and that connects a catalytic converter to an exhaust pipe.

FIG. 1 shows a vehicle exhaust system 10 where exhaust gases are directed from a vehicle engine 12 to downstream exhaust components that include a catalytic converter 14. As known, the catalytic converter 14 converts toxic by-products of the exhaust gases to less toxic substances by way of catalysed chemical reactions. The catalytic converter 14 includes a substrate 16 positioned within a housing 18 that has an exhaust gas inlet 20 and an exhaust gas outlet 22. As the exhaust gas flows through the substrate 16, pollutants such as carbon monoxide, unburned hydrocarbon, and oxides of nitrogen are converted to less toxic substances such as carbon dioxide and water, for example.

An end cap module 24 is mounted to one end of the catalytic converter 14. The end cap module 24 includes an inlet 26 that receives exhaust gases from an exhaust pipe 28. Additionally, the end cap module 24 includes mount interface 30 such that the end cap module 24 can be mounted to a vehicle structure 32, such as a chassis for example. Exhaust gases flow from the engine 12 into the exhaust pipe 28, then flow through the end cap module 24 and into the catalytic converter 14 where the gases exit the outlet 22. Exhaust gases from the outlet 22 are then directed to additional downstream exhaust components 34 and eventually exit to atmosphere via a tailpipe.

Figure 2:
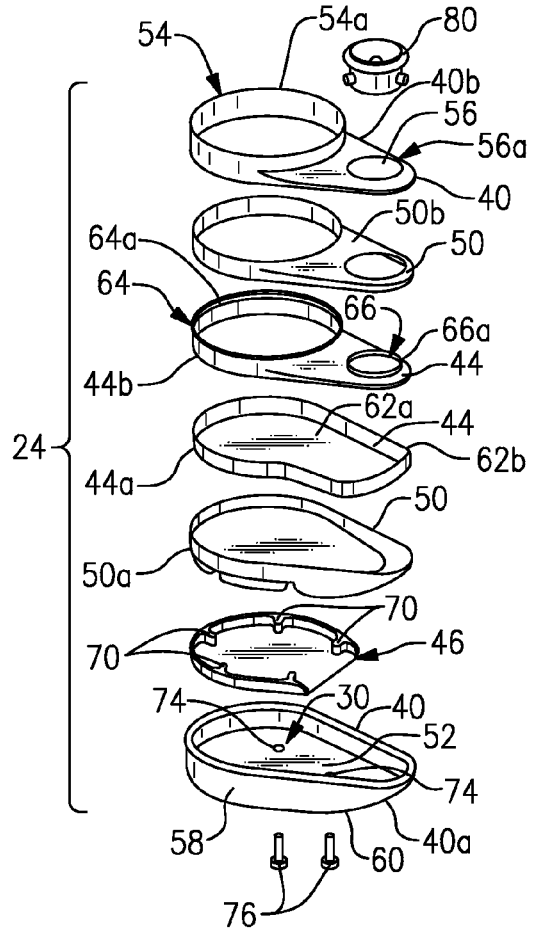
FIG. 2 is an exploded view of an end cap module incorporating the subject invention.

As shown in FIG. 2, the end cap module 24 includes outer skin 40 defining an internal cavity 42 (FIG. 3) and an inner skin 44 positioned within the internal cavity 42. The outer skin 40 includes the mount interface 30 that is configured for attachment to the vehicle structure 32 (FIG. 1). A cast internal sub-structure 46 is also mounted within the internal cavity 42. Any suitable casting material capable of withstanding the high temperature and corrosive environment of the vehicle exhaust system 10 can be used, such as cast iron for example. The inner skin 44 is positioned within the internal cavity 42 such that the cast internal sub-structure 46 is positioned, i.e. sandwiched, between the inner skin 44 and the outer skin 40. The inner skin 44 provides an inner surface that at least partially defines an exhaust gas passageway 48 (FIG. 4).

In one example, insulation 50 is installed in an air gap between the inner skin 44 and the outer skin 40. Any type of insulating material suitable for the high temperature and corrosive environment of the vehicle exhaust system 10 can be used within the end cap module 24. Optionally, the air gap alone can provide an insulating effect.

The outer skin 40 is comprised of at least a first portion 40*a* and a second portion 40*b*. The first portion 40*a* includes a base surface 52 that includes the mount interface 30, and the second portion 40*b* includes a first connection interface 54 for connection the catalytic converter 14 and a second connection interface 56 for connection to the exhaust pipe 28. The first connection interface 54 is defined by an opening 54*a* formed within the second portion 40*b* of the outer skin. The second connection interface 56 is defined by an opening 56*a* formed within the second portion 40*b* of the outer skin.

The first portion 40*a* includes an upwardly extending wall portion 58 that extends outwardly from a periphery of the base surface 52 to define, at least in part, the internal cavity 42. The cast internal sub-structure 46 rests on the base surface 52 such that the first portion 40*a* of the outer skin 40 is sandwiched between the vehicle structure 32 and the cast internal sub-structure 46. In one example, the outer skin 40 is comprised of sheet metal. The sheet metal preferably comprises a stainless steel such that an exterior surface 60 of the outer skin 40 does not require paint, i.e. external surface 60 comprises an unpainted surface. This reduces cost compared to prior cast designs which required a coat of paint to prevent rusting.

The inner skin 44 is comprised of at least a first portion 44*a* and a second portion 44*b* that are attached to each other to form the exhaust gas passageway 48. The first portion 44*a* includes a base surface 62*a* and upwardly extending wall portion 62*b* that define the exhaust gas passageway 48. The second portion 44*b* defines a first connection interface 64 in alignment with the first connection interface 54 of the second portion 40*b* of the outer skin 40 and a second connection interface 66 in alignment with the second connection interface 56 of the second portion 40*b* of the outer skin 40. The first connection interface 64 is defined by an opening 64*a* formed within the second portion 44*b* of the inner skin 44. The opening 64*a* is aligned with the opening 54*a* in the outer skin 40. The second connection interface 66 is defined by an opening 66*a* formed within the second portion 44*b* of the outer skin 44. The opening 66*a* is aligned with the opening 56*a* in the outer skin.

Figure 3:
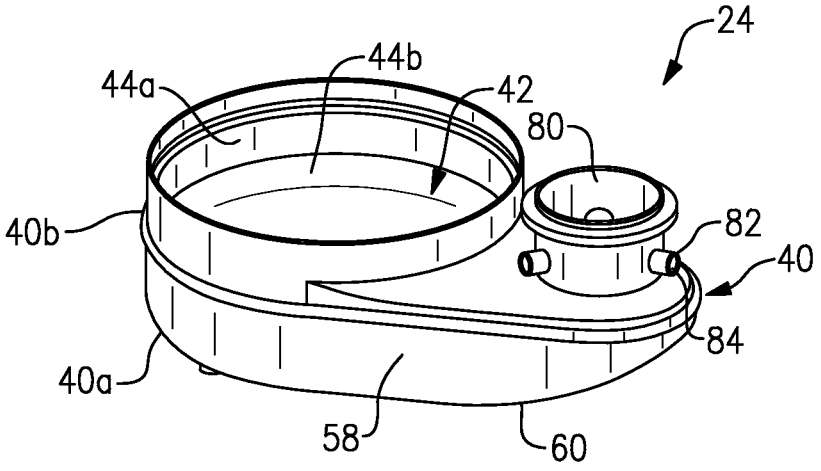
FIG. 3 a perspective view of the end cap module of FIG. 2.
Figure 4:
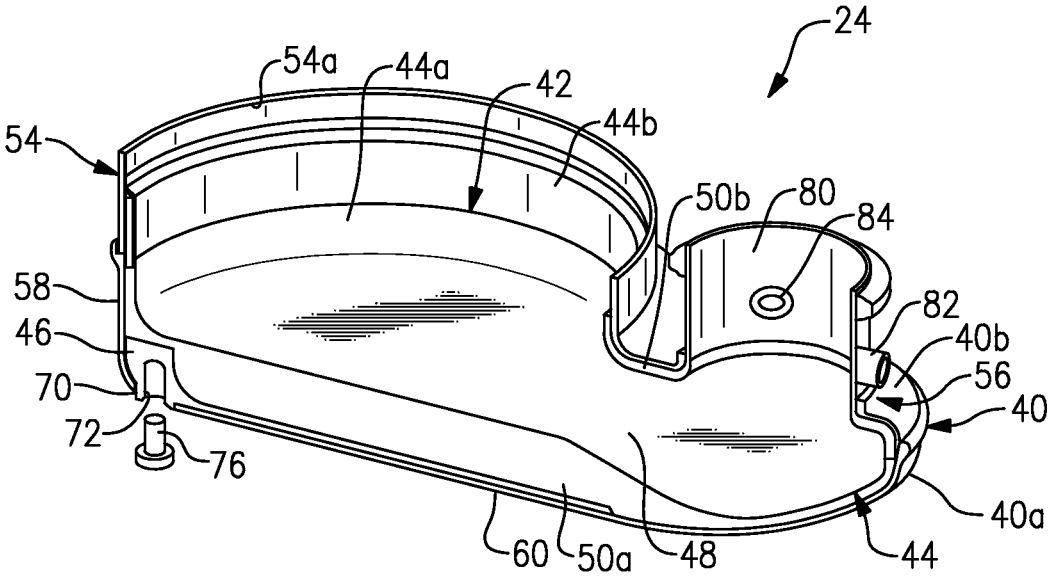
FIG. 4 is a section view of the end cap module of FIG. 3.

In the example shown in FIGS. 2-4, the first portion 40*a* of the outer skin 40 rests on a mount surface of the vehicle structure 32. The cast internal sub-structure 46 rests on the base surface 52 of the first portion 40*a* of the outer skin 40. A first layer of insulation 50*a* is positioned between the cast internal sub-structure 46 and the first portion 44*a* of the inner skin 44. The second portion 44*b* of the inner skin 44, which forms an upper portion of the inner skin 44, is then fit onto the first portion 44*a* of the inner skin 44 to form the exhaust gas passageway 48. A second layer of insulation 50*b* is positioned between the second portion 44*b* of the inner skin 44 and the second portion 40*b* of the outer skin 40. Thus, the end cap module 24 comprises a structure of layered sheet metal with an integrated cast sub-structure, which provides a weight savings compared to prior fully cast designs. Further, the cast sub-structure rigidly holds the end module in place by sandwiching the outer skin 40 against the vehicle structure 32.

In one example, the cast internal sub-structure 46 includes a plurality of fastener bosses 70 with a first set of fastener openings 72. The outer skin 40 includes a second set of fastener openings 74 that are aligned with the first set of fastener openings 72. A plurality of fasteners 76 are received within the first 72 and second 74 sets of fastener openings to secure the cast internal sub-structure 46 and outer skin 40 to the vehicle structure 32. Thus, the fasteners 76 fasten the cast internal sub-structure 46 rigidly to the vehicle structure 32 with a protective layer of sheet metal, i.e. the first portion 40*a* of the outer skin 40, between the cast internal sub-structure 46 and vehicle structure 32. This results in mount structure, i.e. the cast internal sub-structure 46, that holds the end cap module 24 in place under high axial, torsional and bending loads, but which is also protected by an exterior skin, i.e. outer skin 40, that does not require paint.

In one example, an exhaust pipe connector 80 is connected to the second connection interface 56 of the outer skin 40. The exhaust pipe connection 80 comprises a cylindrical cuff or sleeve that is attached to the end cap module 24. In one example, the exhaust pipe connector includes at least one sensor boss 82. The sensor boss 82 includes an opening 84 configured to receive a sensor that is used to measure or monitor any of various exhaust gas characteristics as known. The exhaust pipe 28 is then connected to the end cap module 24 via the connector 80.

As discussed above, the end cap module 24 is rigidly attached to the vehicle structure 32 via fasteners 76. The various components of the cap module 24 are also attached to each other by any of various attachment methods. For example, the first 40*a* and second 40*b* portions of the outer skin 40, and the first 44*a* and second 44*b* portions of the inner skin 44 can be attached to each other by welding or brazing. In one example, the connector 80 is also attached to the end cap module 24 by welding or brazing.

In one example, the end cap module 24 is assembled as follows. First, the first 44*a* and second 44*b* portions of the inner skin 44 are attached to each other by welding, brazing, etc. Next, if needed, the insulation layers 50*a*, 50*b* are positioned around the inner skin 44. Next, the inner skin 44 is attached to the second portion 40*b* of the outer skin 40 by welding, brazing, etc. The cast internal sub-structure 46 is then placed on and/or fixed to the first portion 40*a* of the outer skin 40. Finally, the first 40*a* and second 40*b* portions of the outer skin 40 are attached to each other. The end cap module can then be secured to the vehicle structure 32.

In the configuration shown in FIGS. 1-4, the first connection interface 54 of the outer skin 40 defines a first center axis A1 and the second connection interface 56 defines a second center axis A2 that is spaced apart and parallel to the first center axis A1. The catalytic converter 14 is coaxial with the first center axis A1 and the exhaust pipe 28 is coaxial with the second center axis A2. This provides a compact, lightweight configuration.

As such, the end cap module 24 comprises a combination of sheet metal and cast iron that reduces cost and weight, but still retains necessary structural integrity when compared to prior designs. Further, the end cap module 24 provides a functional benefit of having a quick thermal inertia such that the module acts as a small heat sink and takes a short time to achieve temperature changes. The subject end cap module 24 also provides an additional advantage in that the outer surface does not need to be painted and holds up over time in the corrosive operating environment to which the end cap module 24 is subjected. Further, there is a structural support/load bearing portion, i.e. the cast internal sub-structure 46, which is protected on both sides by the inner 44 and outer 40 skins. Thus, the end cap module 24 is able to carry the necessary operational loads without rusting.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. An end cap module for a vehicle exhaust system comprising:

an outer skin defining an internal cavity, wherein the outer skin includes a base to face a vehicle structure positioned on one side of the base, the base including a mount interface configured for attachment to the vehicle structure;

a first connection interface configured to attach to a first exhaust component;

a second connection interface configured to attach to a second exhaust component, the first and second connection interfaces positioned on an opposite side of the base from the vehicle structure;

a cast internal sub-structure mounted within the internal cavity, wherein the cast internal sub-structure comprises a solid plate; and an inner skin positioned within the internal cavity such that one side of the solid plate fits against the inner skin and an opposite side of the solid plate fits against the outer skin, wherein the inner skin defines an exhaust gas passageway, and wherein the outer skin, cast internal sub-structure, and the inner skin are secured together to form an end cap that connects an outlet from one of the first and second exhaust components to an inlet of the other of the first and second exhaust components.

2. The end cap module according to claim 1, including at least one layer of insulation sandwiched directly between the inner skin and the solid plate.

3. The end cap module according to claim 1, wherein the inner skin is comprised of at least a first portion and a second portion, the first portion including an internal skin surface that defines the exhaust gas passageway, and the second portion including a first opening for the first connection interface and a second opening for the second connection interface.

4. The end cap module according to claim 1, wherein the outer skin is comprised of sheet metal having an unpainted exterior surface.

5. The end cap module according to claim 1, wherein the cast internal sub-structure includes a plurality of fastener bosses with a first set of fastener openings, and wherein the outer skin includes a second set of fastener openings that are aligned with the first set of fastener openings, and including a plurality of fasteners received within the first and second sets of fastener openings to secure the cast internal sub-structure and outer skin to the vehicle structure.

6. The end cap module according to claim 1, wherein the first connection interface defines a first central axis and the second connection interface defines a second central axis that is spaced apart from and parallel to the first central axis, and wherein the first and second central axes are perpendicular to the base.

7. The end cap module according to claim 1, including a casting positioned between the inner skin and the outer skin, the casting comprising the cast internal sub solid plate.

8. The end cap module according to claim 7, wherein the casting is completely enclosed between the inner and outer skin, and including at least one layer of insulation positioned directly between the casting and the inner skin and at least one layer of insulation between the casting and the outer skin.

9. The end cap module according to claim 1, wherein the inner and outer skin include a first set of inner and outer skin aligned openings that are configured to connect to the outlet from one of the first and second exhaust components, and wherein the inner and outer skin include a second set of inner and outer skin aligned openings that are configured to connect to the inlet of the other of the first and second exhaust components, and wherein the solid plate is positioned in an overlapping relationship with at least one of the first and second sets of inner and outer skin aligned openings.

10. The end cap module according to claim 9, wherein one of the first and second sets of inner and outer skin aligned openings is greater in size than the other of the first and second sets of inner and outer skin aligned openings.

11. The end cap module according to claim 9, wherein the inlet has an inlet axis that is parallel to an outlet axis of the outlet, and wherein the inner skin provides an open unobstructed exhaust gas path from the inlet to the outlet.

12. The end cap module according to claim 1, wherein the outer skin is comprised of at least a first portion and a second portion, the first portion including the base that includes the mount interface, and the second portion including a first opening for the first connection interface and a second opening for the second connection interface.

13. The end cap module according to claim 12, wherein the first connection interface comprises a catalytic converter connection interface and the second connection interface comprises an exhaust pipe connection interface.

14. The end cap module according to claim 12, wherein the cast internal sub-structure rests on an inner surface of the base such that the first portion of the outer skin is sandwiched between the vehicle structure and the cast internal sub-structure.

15. The end cap module according to claim 14, wherein the solid plate is fixed to the first portion of the outer skin, and including at least one layer of insulation sandwiched directly between the first portion of the outer skin and the solid plate.

16. An end cap module for a vehicle exhaust system comprising:

an outer skin including at least a first outer skin portion and a second outer skin portion, the first outer skin portion including a base to face a vehicle structure positioned on one side of the base, the base including a mount interface configured for attachment to the vehicle structure, and the second outer skin portion defining a first connection interface configured to attach to a first exhaust component and a second connection interface configured to attach to a second exhaust component, the first and second connection interfaces positioned on an opposite side of the base from the vehicle structure;

a cast internal sub-structure supported by the first outer skin portion, wherein the cast internal sub-structure comprises a solid plate; and an inner skin mounted between the first outer skin portion and the second outer skin portion to define an open and unobstructed exhaust gas passageway that extends between the first and second connection interfaces, and wherein the solid plate has one side that fits against the inner skin and an opposite side that fits against the first outer skin portion.

17. The end cap module according to claim 16, wherein the outer skin is comprised of unpainted sheet metal.

18. The end cap module according to claim 16, wherein the first exhaust component comprises a catalytic converter and the second exhaust component comprises an exhaust pipe, and wherein the first connection interface is configured for attachment to the catalytic converter defining a first axis and the second connection interface is configured for attachment to the exhaust pipe defining a second axis that is parallel to the first axis, and wherein the endcap module connects an outlet from the exhaust pipe to an inlet of the catalytic converter.

19. The end cap module according to claim 16, wherein the inner skin is comprised of at least a first inner skin portion and a second inner skin portion, the first inner skin portion including an internal skin surface that defines the exhaust gas passageway, and the second inner skin portion including a first opening aligned with the first connection interface and a second opening aligned with the second connection interface in the second outer skin portion.

20. The end cap module according to claim 19, wherein the first connection interface defines a first central axis and the second connection interface defines a second central axis that is spaced apart from and parallel to the first central axis, and wherein the first and second central axes are perpendicular to the base.

21. The end cap module according to claim 16, including a casting positioned between the inner skin and the outer skin, the casting comprising the solid plate.

22. The end cap module according to claim 21, wherein the casting is completely enclosed between the inner and outer skin, and including at least one layer of insulation positioned directly between the casting and the inner skin and at least one layer of insulation between the casting and the outer skin.

23. An end cap module for a vehicle exhaust system comprising:

an outer skin including at least a first outer skin portion and a second outer skin portion, the first outer skin portion including a base to face a vehicle structure positioned on one side of the base, the base including a mount interface configured for attachment to the vehicle structure, and the second outer skin portion defining a first connection interface configured to attach to a first exhaust component and a second connection interface configured to attach to a second exhaust component, the first and second connection interfaces positioned on an opposite side of the base from the vehicle structure;

a cast internal sub-structure supported by the first outer skin portion;

an inner skin mounted between the first outer skin portion and the second outer skin portion to define an open and unobstructed exhaust gas passageway that extends between the first and second connection interfaces, and wherein the cast internal sub-structure is positioned between the inner skin and first outer skin portion, and wherein the inner skin is comprised of at least a first inner skin portion and a second inner skin portion, the first inner skin portion including an internal skin surface that defines the exhaust gas passageway, and the second inner skin portion including a first opening aligned with the first connection interface and a second opening aligned with the second connection interface in the second outer skin portion; and a first layer of insulation between the cast internal sub-structure and the first inner skin portion and a second layer of insulation between the second outer skin portion and the second inner skin portion.

24. A vehicle exhaust system comprising:

a catalytic converter;

an exhaust pipe; and an end cap module that connects the catalytic converter to the exhaust pipe, the end cap module comprising an outer skin including at least a first outer skin portion and a second outer skin portion, the first outer skin portion including a base to face a vehicle structure positioned on one side of the base, the base including a mount interface configured for attachment to the vehicle structure, and the second outer skin portion defining a first connection interface to the catalytic converter and a second connection interface to the exhaust pipe, the first and second connection interfaces positioned on an opposite side of the base from the vehicle structure, a cast internal sub-structure mounted to the first outer skin portion, wherein the cast internal sub-structure comprises a solid plate, and an inner skin mounted between the first outer skin portion and the second outer skin portion to define an exhaust gas passageway that extends between the first and second connection interfaces, wherein the solid plate has one side that fits against the inner skin and an opposite side that fits against the first outer skin portion.

25. The vehicle exhaust system according to claim 24, including a casting positioned between the inner skin and the outer skin, the casting comprising the solid plate.

26. The vehicle exhaust system according to claim 25, wherein the casting is completely enclosed between the inner and outer skin, and including at least one layer of insulation positioned directly between the casting and the inner skin and at least one layer of insulation between the casting and the outer skin.

27. The vehicle exhaust system according to claim 24, wherein the first connection interface defines a first center axis and the second connection interface defines a second center axis that is spaced apart and parallel to the first center axis.

28. The vehicle exhaust system according to claim 27, wherein the cast internal sub-structure includes a plurality of fastener bosses with a first set of fastener openings, and wherein the first outer skin portion includes a second set of fastener openings that are aligned with the first set of fastener openings, and including a plurality of fasteners received within the first and second sets of fastener openings to secure the cast internal sub-structure and outer skin to the vehicle structure.

29. The vehicle exhaust system according to claim 27, wherein the inner skin provides an open unobstructed exhaust gas passageway extending from an outlet of the exhaust pipe to an inlet to the catalytic converter.

30. A vehicle exhaust system comprising:

a catalytic converter;

an exhaust pipe; and an end cap module that connects the catalytic converter to the exhaust pipe, the end cap module comprising an outer skin including at least a first outer skin portion and a second outer skin portion, the first outer skin portion including a base to face a vehicle structure positioned on one side of the base, the base including a mount interface configured for attachment to the vehicle structure, and the second outer skin portion defining a first connection interface to the catalytic converter and a second connection interface to the exhaust pipe, the first and second connection interfaces positioned on an opposite side of the base from the vehicle structure, a cast internal sub-structure mounted to the first outer skin portion, an inner skin mounted between the first outer skin portion and the second outer skin portion to define an exhaust gas passageway that extends between the first and second connection interfaces, wherein the cast internal sub-structure is positioned between the inner skin and first outer skin portion, and wherein the inner skin is comprised of at least a first inner skin portion and a second inner skin portion, the first inner skin portion including an internal skin surface that defines the exhaust gas passageway, and the second inner skin portion including a first opening aligned with the first connection interface and a second opening aligned with the second connection interface in the second outer skin portion, and a first layer of insulation between the cast internal sub-structure and the first inner skin portion and a second layer of insulation between the second outer skin portion and the second inner skin portion.

* * * * *